US005080199A

United States Patent [19]

McCallum, III

[11] Patent Number: 5,080,199

[45] Date of Patent: Jan. 14, 1992

[54] ELEVATOR CABLE HANGER

[75] Inventor: William J. McCallum, III, Rocky Mount, N.C.

[73] Assignee: Siecor Corporation, Hickory, N.C.

[21] Appl. No.: 588,049

[22] Filed: Sep. 24, 1990

[51] Int. Cl.[5] ..... B66B 9/00

[52] U.S. Cl. ..... 187/1 R; 248/74.1

[58] Field of Search ..... 187/1 R, 20; 248/74.1, 248/74.3

[56] References Cited

U.S. PATENT DOCUMENTS

| | | | |
|---|---|---|---|
| 3,054,586 | 9/1962 | Kirkup | 248/74.1 |
| 3,240,863 | 3/1966 | Brede | 248/74.1 |
| 3,739,435 | 6/1973 | Baker | 248/74.1 |

FOREIGN PATENT DOCUMENTS

| | | | |
|---|---|---|---|
| 106586 | 4/1990 | Japan | 187/1 R |
| 253858 | 11/1926 | United Kingdom | 248/74.1 |

*Primary Examiner*—Robert P. Olszewski
*Assistant Examiner*—Kenneth Noland
*Attorney, Agent, or Firm*—J. David Abernethy

[57] ABSTRACT

An improved elevator cable hanger, which may be mounted either to an elevator car or to the motor room end of an elevator traveling cable, includes a single unitary metallic bracket having support means for supporting an elavator cable strength member, a plate mounted to an exterior surface, and a curved member providing lateral support to an elevator cable hanging straight from the support means. At least one strap secures the elevator cable to the bracket and a friction material mounted to the curved member prevents cable rotation during movement of the elevator car.

4 Claims, 2 Drawing Sheets

ELEVATOR CABLE HANGER

BACKGROUND OF THE INVENTION

The field of the invention is elevator cable hangers.

The different types of cables are normally found in the hoistways of elevator systems. The function of the hoist rope, which is attached between the top of the elevator car and the counterweight, is to raise and lower the elevator car. The function of the compensating cable, which is attached between the bottom of the elevator car and the bottom of the counterweight, is to counterbalance the weight of the hoist rope. The traveling cable, also sometimes called lighting or control cable, is a cable which has transmission media for supplying electricity to the elevator car, transmitting signals from the elevator car to the controller for the proper selection of floors, and to supply heating or the like to the elevator car.

Elevator cable hangers are used to attach traveling cable to the elevator car, which is the attachment point for one end of the traveling cable, and the attachment point for the other end of the traveling cable, the other end referred to herein as the motor room end.

The older practice has been to secure the cable hanger on the motor room end of the traveling cable immediately below a junction box in the mid-point of the elevator hoistway. A metal trough is used as a duct for electrical conduit between the junction box and the controller, which is contained in the motor room over the hoistway. A more recent method is to attach the motor room end of the elevator cable hanger at the top of the hoistway; this method is called a motor room attachment or a "home run" attachment. In this case, no junction box is used and the metal trough can be very short. In either case, some sort of hanger must be used to secure the motor room end of the traveling cable.

There are several methods of attaching traveling cables at the elevator car, hoistway junction box, or the motor room. Three standard methods include steel core hanging devices, steel support wire clamps, and wire mesh grips.

When a steel core hanging device is used, a strength member hanger is used to secure a central strength member, normally a wire rope, of a traveling cable. The strength member support is mounted at the top of a bracket, which is bolted to a structural member or other secure location in the hoistway or on the elevator car. The rest of the traveling cable is suspended from the strength member hanger. Prior art has been for the installer to provide a block of wood and carve out an indentation more or less corresponding to the shape of the cable outer jacket. A metal clamp is then placed over the cable and attached by screws or the like to the wood block. Sometimes another block of wood is carved out and used in conjunction with the first wood block to secure the traveling cable.

Although the use of wood blocks secures one end of the traveling cable from excessive swaying during movement of the elevator car, the rough carved wood blocks often cause excessive chafing and wear to the traveling cable outer jacket. It is also found that if the clamping device is too loose, the traveling cable is allowed to rotate, which also causes premature wear to the traveling cable. On the other hand, if the bracket is secured too tightly, the traveling cable is unduly compressed and damage may result to the copper wires or other communication elements in the cable.

SUMMARY OF THE INVENTION

The improved elevator cable hanger claimed herein includes support means for supporting an elevator cable strength member, a first plate, and mounting means for mounting the first plate to an exterior surface, as taught by the prior art. The improved hanger, however, includes a single metal bracket having the support means and first plate previously listed and a curved member mounted parallel but not coplanar with the first plate to provide lateral support to an elevator cable hanging straight from the support means. At least one strap secures an elevator cable to the curved member, and a high friction material is mounted to the curved member; the elevator cable is thereby secured against not only swaying in the hoistway but also rotation transverse to its longitudinal axis. The hanger may be mounted to secure either the motor room end or the elevator car end of an elevator cable.

BRIEF DESCRIPTION OF THE DRAWINGS

The detailed description of the preferred embodiment is made with reference to the drawings, of which.

DETAILED DESCRIPTION OF THE PREFERRED EMBODIMENT

Figure 1:
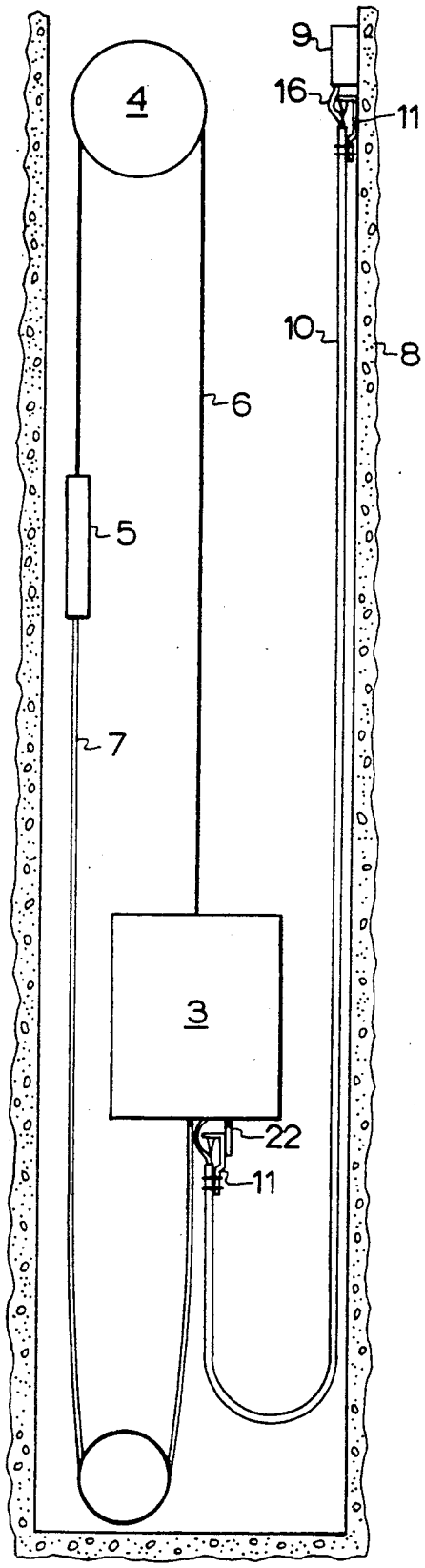
FIG. 1 is a diagrammatic side elevation view of an elevator car system.

In FIG. 1, elevator car 3, having mounting surface 22, is suspended from hoist rope 6. Hoist rope 6 is connected over sheave 4 to counterweight 5. Compensating cable 7 is connected to the bottom surfaces of car 3 and counterweight 5. Junction box 9 is mounted to elevator shaft 8. Traveling cable 10 hangs between brackets 11 at its motor room end (under junction box 9) and at its elevator car end (at elevator car 3).

Figure 2:
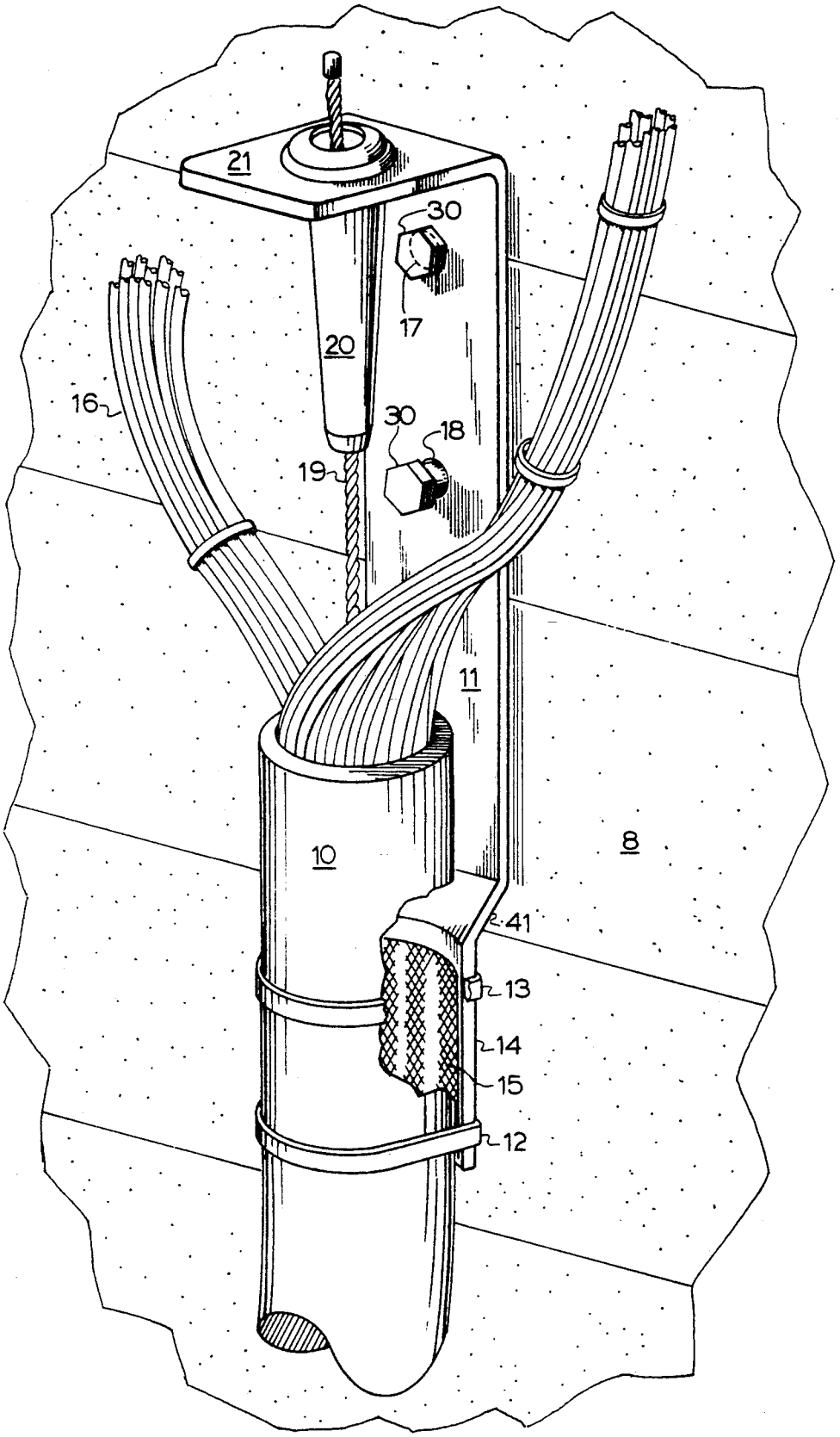
FIG. 2 is an enlarged perspective view of the elevator cable hanger mounted in the hoistway.

FIG. 2 shows the use of the improved hanger at the motor room end of traveling cable 10. The end of the outer jacket of cable 10 is stripped away, exposing cable strength member 19. Strength member 19 is suspended from plate 21 by steel core hanging device 20. Electrical wires 16 proceed to the motor room.

First plate 11 is mounted to elevator shaft 8 through holes 17, 18 by bolts 30. Plate 22, a part of elevator car 3, may serve as another surface for mounting the bracket. The bracket is a single member made of steel or similar strong metal and includes plate 21, plate 11, plate 41, and curved member 14. Curved member 14 is held parallel to but not coplanar with first plate 11 by plate 41. The angle and length of plate 41 are such that cable 10 hangs straight from steel core hanging device 20.

Elevator cable 10 is secured to curved member 14 by wide nylon straps 12, 13, which may be Ty-Raps or the like. Friction tape 15 is mounted to curved member 14 by an adhesive. Alternately, curved member 14 may be stamped to have a gnarled surface to provide friction, or a mixture such as glue and sand may be sprayed on curved member 14. Straps 12, 13 are tightened so that cable 10 does not sway or rotate during motion of elevator car 3, but not so tightly as to unduly crimp conductors 16.

What is claimed is:

1. An elevator cable hanger, comprising:

(a) a bracket, comprising support means for supporting an elevator cable strength member; a metallic member comprising a first plate and a curved member parallel but not coplanar with the first plate to provide lateral support to an elevator cable hanging straight from the support means; a high friction material mounted to the curved member for preventing rotation of the elevator cable transverse to its longitudinal axis; mounting means for mounting the first plate to an exterior surface; and, (b) at least one strap for securing an elevator cable to the curved member.

2. An elevator cable hanger as recited in claim 1 mounted to an elevator car.

3. An elevator cable hanger as recited in claim 1 mounted to the motor room end of an elevator cable.

4. An elevator cable hanger, comprising:

a bracket, comprising:

(i) support means for supporting an elevator cable strength member;

(ii) a first plate;

(iii) mounting means for mounting the first plate to an exterior surface;

(iv) a curved member mounted parallel but not coplanar with the first plate to provide lateral support to an elevator cable hanging straight from the support means, said curved member having a high friction material mounted thereto for preventing rotation of said elevator cable transverse to its longitudinal axis; and, (b) at least one strap for securing an elevator cable to the curved member.

* * * * *